US006705855B2

(12) United States Patent
Nagayama et al.

(10) Patent No.: US 6,705,855 B2
(45) Date of Patent: Mar. 16, 2004

(54) LOW-NOX BURNER AND COMBUSTION METHOD OF LOW-NOX BURNER

(75) Inventors: Satoshi Nagayama, Tokyo (JP); Shin Shizukuishi, Tokyo (JP)

(73) Assignee: Tokyo Gas Co., Ltd., Tokyo (JP)

( * ) Notice: Subject to any disclaimer, the term of this patent is extended or adjusted under 35 U.S.C. 154(b) by 0 days.

(21) Appl. No.: 09/739,738

(22) Filed: Dec. 20, 2000

(65) Prior Publication Data

US 2001/0010896 A1 Aug. 2, 2001

(30) Foreign Application Priority Data

Dec. 22, 1999 (JP) ..... 11-365384

(51) Int. Cl.[7] ..... F23N 001/00

(52) U.S. Cl. ..... 431/12; 431/115; 431/175; 431/354

(58) Field of Search ..... 431/8, 9, 10, 12, 431/181, 115, 116, 182, 350–354, 187

(56) References Cited

U.S. PATENT DOCUMENTS

| | | | | | |
|---|---|---|---|---|---|
| 3,180,394 | A | * | 4/1965 | Conway | 431/181 |
| 4,289,474 | A | | 9/1981 | Honda et al. | |
| 4,909,728 | A | * | 3/1990 | Nakamoto et al. | 431/176 |
| 5,044,931 | A | * | 9/1991 | Van Eerden et al. | 431/10 |
| 5,486,108 | A | * | 1/1996 | Kubota | 431/350 |
| 5,662,467 | A | | 9/1997 | Jones | |
| 5,685,705 | A | * | 11/1997 | Knopfel | 431/9 |

FOREIGN PATENT DOCUMENTS

| | | | | |
|---|---|---|---|---|
| EP | 0579315 A1 | | 1/1994 | |
| JP | 52-24341 | * | 2/1977 | 431/175 |
| JP | 53-126527 | * | 11/1978 | 431/181 |
| JP | 02052911 | | 2/1990 | |
| JP | 04313608 | | 4/1991 | |
| JP | 4-350406 | * | 12/1992 | 431/175 |
| JP | 6-42709 | * | 2/1994 | 431/175 |
| JP | 6-137527 | * | 5/1994 | 431/10 |

OTHER PUBLICATIONS

European Search Report dated Mar. 5, 2001.

* cited by examiner

*Primary Examiner*—James C. Yeung
(74) *Attorney, Agent, or Firm*—Arent Fox Kintner Plotkin & Kahn, PLLC

(57) ABSTRACT

Provision of a low-NOx burner allowed to further reduce NOx only by structural design of the burner in comparison with prior art. The low-NOx burner comprises a main nozzle 13 for injecting a premixture formed by mixing fuel and an oxidizer, and a secondary flame-holding nozzle 12A for making a premixture or an oxidizer impinge on the premixture injected from the main nozzle 13, in a direction at an approximately right angle to the injection direction of the main nozzle 13.

5 Claims, 6 Drawing Sheets

LOW-NOX BURNER AND COMBUSTION METHOD OF LOW-NOX BURNER

BACKGROUND OF THE INVENTION

1. Field of the Invention

This invention relates to a low-NOx burner.

2. Description of the Related Art

Generally, reduction of NOx produced during combustion is an essential challenge for gas burners used for a boiler, a cold/hot water producer or the like.

For reduction of NOx, there are various techniques: 1) a thick and thin fuel combustion, 2) multi-stage combustion of fuels or oxidizers, 3) premix lean combustion, 4) exhaust gas recirculation (EGR), 5) steam or water injection, and so on. Most of conventional low-NOx burners include a mechanism for employing these techniques singly or in combination in order to reduce NOx emission.

At present, the strictest regulation against NOx emission concentrations is instituted on combustion appliances used for a boiler, cold/hot water producer and so on. For example, the approval low-NOx standard mandated by Tokyo municipality is the NOx emission concentration of 60 ppm (a converted value in $O_2$=0%, (the same hereinafter)) or less.

Consequently, recent low-NOx burners are designed to reduce NOx emission to a target of 60 ppm or less which is the approval low-NOx standard mandated by Tokyo municipality, most of which carry out combustion at a NOx emission concentration of the order of 40 ppm to 60 ppm.

Instead of implementing a reduction in NOx by the structural design of the burner, some conventional boilers use a water tube serving as a secondary side to cool flame so as to limit the NOx emission concentration to 35 ppm.

However, such technique of cooling flames to reduce NOx needs a structure for cooling the flames, such as the water tube on the secondary side, or the like. For this reason, it is impossible to use this technique for a process heater except for a boiler or a cold/hot water producer.

Until now, it was impossible to limit the NOx emission concentration to 35 ppm or less only by the structural design of the burners. Previously, there has been anticipation for the development of a low-NOx burner which is capable of achieving further reduction of NOx and widely used for things besides the boiler and the cold/hot water producer.

SUMMARY OF THE INVENTION

The present invention has been made for responding to the previously discussed conventional needs of the low-NOx burner.

It is therefore an object of the present invention to provide a low-NOx burner further reducing NOx, in comparison with conventional burners, by structural design only.

To accomplish the above object, a low-NOx burner according to a first invention is characterized by including: a nozzle member for injecting a premixture formed by mixing fuel and an oxidizer; and a flame holding member for injecting a premixture or an oxidizer toward the premixture injected from the nozzle member in a direction to intersect the injection direction from the nozzle member.

The low-NOx burner according to the first invention injects the premixture, formed by mixing an oxidizer such as air and fuel and fed into the low-NOx burner, from the nozzle member at high velocity, to induce combustion gas in a furnace to produce self-induced exhaust gas recirculation.

The premixture or oxidizer injected from the flame holding member is blown on the premixture injected from the nozzle member, in the direction in which both injection directions intersect each other, at the downstream position in the injection direction from the nozzle member.

This produces a circulation flow around the meeting point of the premixture injected from the nozzle member and the premixture or oxidizer injected from the flame holding member. The circulation flow serves as an ignition source to hold the flame, resulting in holding the continuous combustion of the burner.

According to the foregoing first invention, since the combustion is produced after the premixture injected from the nozzle member involves and mixes with the exhaust gas in the furnace, it is possible that reduction in oxygen concentration effected by mixing with the exhaust gas reduces a NOx emission concentration. Moreover, since the flame hold is moderately executed, similar to the so-called lifted flame, at a distance from the furnace wall, the flame temperature decreases. This permits further reduction in NOx emission concentration.

To accomplish the above object, the low-NOx burner according to a second invention is characterized, in addition to the configuration of the first invention, in that the injection direction of the premixture from the nozzle member and the injection direction of the premixture or the oxidizer from the flame holding member intersect each other at approximate right angles.

According to the low-NOx burner of the second invention, the premixture or oxidizer injected from the flame holding member is blown on the premixture injected from the nozzle member at an approximate right angle. This improves the flame hold to thereby produce the effect of maintaining a large stable combustion range.

To accomplish the above object, the low-NOx burner according to a third invention is characterized, in addition to the configuration of the first invention: in that a plurality of the nozzle members are circularly arranged on a front face of a body casing of the burner; and in that the flame holding member is situated at the center of the nozzle members which are circularly arranged on the front face of the body casing, and it includes injector orifices which are positioned downstream from the position of the nozzle member in the injection direction and have an axis extending in a direction substantially perpendicular to the injection direction of the nozzle member.

According to the low-NOx burner of the third invention, the premixtures respectively injected from the injector orifices of the flame holding member which is arranged in the front central portion of the body casing, are blown at approximate right angles on the corresponding premixtures injected from a plurality of the nozzle members circularly arranged on the front face of the body casing. On the periphery of the meeting points of both premixtures, circulation flows take place. The circulation flow serves as an ignition source to hold the flame, resulting in holding the continuous combustion of the burner.

To accomplish the above object, the low-NOx burner according to a fourth invention is characterized, in addition to the configuration of the first invention: in that a plurality of the nozzle members are linearly arranged on a front face of a body casing of the burner; and in that the flame holding member is situated at a position opposing to the nozzle members on the front face of the body casing, and it includes injector orifices which are positioned downstream from the position of the nozzle member in the injection direction and have an axis extending in a direction substantially perpendicular to the injection direction of each nozzle member.

According to the low-NOx burner of the fourth invention, the premixtures respectively injected from the injector orifices of the flame holding member which is located at a position opposing the nozzle members, are blown on at an approximate right angle on the corresponding premixtures injected from a plurality of the nozzle members linearly arranged on the front face of the body casing. On the peripheries of the meeting points of both premixtures, circulation flows take place. The circulation flow serves as an ignition source to hold the flame, resulting in holding the continuous combustion of the burner.

To accomplish the above object, the low-NOx burner according to a fifth invention is characterized, in addition to the configuration of the first invention: in that a plurality of the nozzle members are circularly arranged on a front face of a body casing of the burner; and in that a plurality of the flame holding members are concentrically aligned with the nozzle members, and respectively comprise injector orifices which are positioned downstream from the position of the nozzle member in the injection direction and have an axis extending in a direction substantially perpendicular to the injection direction of the nozzle member.

According to the low-NOx burner of the fifth invention, the premixtures injected from the injector orifices of the respective flame holding members which are concentrically aligned with the nozzle members, are blown at an approximate right angle on the corresponding premixtures injected from a plurality of the nozzle members circularly arranged on the front face of the body casing. On the peripheries of the meeting points of both premixtures, circulation flows take place. The circulation flow serves as an ignition source to hold the flame, resulting in holding the continuous combustion of the burner.

To accomplish the above object, the low-NOx burner according to a sixth invention is characterized, in addition to the configuration of the first invention: in that a plurality of the nozzle members and a plurality of the flame holding members are alternated on the same circumference; and in that each flame holding member comprises injector orifices which are positioned downstream from the position of the nozzle member in the injection direction and have an axis extending in a direction substantially perpendicular to the injection direction of the nozzle member.

According to the low-NOx burner of the sixth invention, the premixtures injected from the injector orifices of a plurality of the flame holding members which are alternated with the nozzle members on the same circumference, are blown at an approximate right angle on the corresponding premixtures injected from a plurality of the nozzle members circularly arranged on the front face of the body casing. On the peripheries of the meeting points of both premixtures, circulation flows take place. The circulation flow serves as an ignition source to hold the flame, resulting in holding the continuous combustion of the burner.

To accomplish the above object, the low-NOx burner according to a seventh invention is characterized, in addition to the configuration of the first invention, in that the nozzle member and the flame holding member are respectively communicated with chambers formed independently of each other.

According to the low-NOx burner of the seventh invention, it may be possible to feed premixtures containing different percentages of oxidizer individually into the premixture chamber for supplying the premixture into the nozzle members, and the chamber for supplying the premixture or an oxidizer such as air into the flame holding member, in order to inject the premixtures, different in oxidizer percentage, from the nozzle members and the flame holding member, or to inject only the oxidizer from the flame holding member.

Further, according to the low-NOx burner, it is also possible to independently control flow velocities of the premixture injected from the nozzle member and the premixture or oxidizer injected from the flame holding member.

To accomplish the above object, a combustion method of a low-NOx burner according to an eighth invention is characterized, by including the steps of: injecting a premixture formed by mixing fuel and an oxidizer; and making a premixture impinge on the other premixture in a direction to intersect the injection direction of the other premixture for combustion.

According to the combustion method of the low-NOx burner of the eighth invention, the premixture of the fuel and the oxidizer such as air is injected from the nozzle at high velocity to induce the exhaust gas in the furnace, resulting in creating the self-induced exhaust gas recirculation.

Then, on the downstream side of the injection direction of the above premixture, a premixture injected from another nozzle is blown on the other premixture injected at high velocity such that both injection directions intersect.

This produces a circulation flow on the periphery of the meeting point of the premixture injected and the premixture impinging on the other premixture. The circulation flow serves as an ignition source to hold the flame, resulting in holding the continuous combustion of the burner.

Thus, according to the foregoing eighth invention, since the combustion is produced after the premixture injected into the furnace involves and mixes with the exhaust gas in the furnace, it is possible that reduction in oxygen concentration effected by mixing with the exhaust gas reduces a NOx emission concentration. Moreover, since the flame hold is moderately executed, similar to the so-called lifted flame, at a distance from the furnace wall, a flame temperature decreases. This permits further reduction in NOx emission concentration.

To accomplish the above object, the combustion method of the low-NOx burner according to a ninth invention is characterized, in addition to the configuration of the eighth invention, in that the premixture is blown on the other premixture at an approximate right angle.

According to the combustion method of the low-NOx burner of the ninth invention, the premixture injected from another nozzle is blown at an approximate right angle on the premixture injected into the furnace. This facilitates producing circulation flows which effect the flame hold and thus decreases a flame temperature, resulting in a further reduction of the NOx emission concentration.

To accomplish the above object, a combustion method of a low-NOx burner according to a tenth invention is characterized, by including the steps of: injecting a premixture formed by mixing fuel and an oxidizer; and making an oxidizer impinge on the premixture in a direction to intersect the injection direction of the premixture for combustion.

According to the combustion method of the low-NOx burner of the tenth invention, the premixture of the fuel and the oxidizer such as air is injected from the nozzle at high velocity to induce the exhaust gas in the furnace, resulting in creating the self-induced exhaust gas recirculation.

Then, on the downstream side of the injection direction of the premixture, the oxidizer injected from another nozzle is blown on the premixture such that both injection directions intersect each other.

This produces a circulation flow on the periphery of the meeting point of the premixture injected and the oxidizer impinging on the premixture. The circulation flow serves as an ignition source to hold the flame, resulting in holding the continuous combustion of the burner.

Thus, according to the foregoing tenth invention, the combustion is produced after the premixture injected into the furnace involves and mixes with the exhaust gas in the furnace. This allows reduction in oxygen concentration effected by mixing with the exhaust gas to reduce a NOx emission concentration. Moreover, since the flame hold is moderately executed, similar to the so-called lifted flame, at a distance from the furnace wall, a flame temperature decreases. This permits further reduction in NOx emission concentration.

To accomplish the above object, the combustion method of the low-NOx burner according to an eleventh invention is characterized, in addition to the configuration of the tenth invention, in that the oxidizer is blown on the premixture at an approximate right angle.

According to the combustion method of the low-NOx burner of the eleventh invention, the oxidizer from another nozzle is blown at an approximate right angle on the premixture injected into the furnace. This facilitates producing circulation flows which effect the flame hold, and thus decrease a flame temperature, resulting in a further reduction of the NOx emission concentration.

These and other objects and advantages of the present invention will become obvious to those skilled in the art upon review of the following description, the accompanying drawings and appended claims.

DETAILED DESCRIPTION OF THE PREFERRED EMBODIMENT

Most preferred embodiment according to present invention will be described below in detail with reference to the accompanying drawings.

Prior to the description of the embodiment according to the present invention, the relationship between NOx emissions and burner flames will be first explained. Decreasing the flame temperature is important for minimizing NOx.

Observing the relationship between NOx and flame hold, however, high-temperature areas are produced locally in the flames dependent on a sufficient flame hold. This increases a concentration of NOx emissions. In contrast, when the flame hold is insufficient, NOx decreases. However, the insufficient flame hold may cause occurrences of carbon monoxide, oscillating combustion, flame failure and soon. Therefore, decreasing the flame hold for the reduction of NOx has limitation.

The flame hold of the gas burner is a big factor for minimizing NOx emissions from the burner.

The present invention is made by focusing on the relationship between the flame hold of the burner and the concentration of NOx emissions.

Figure 1:
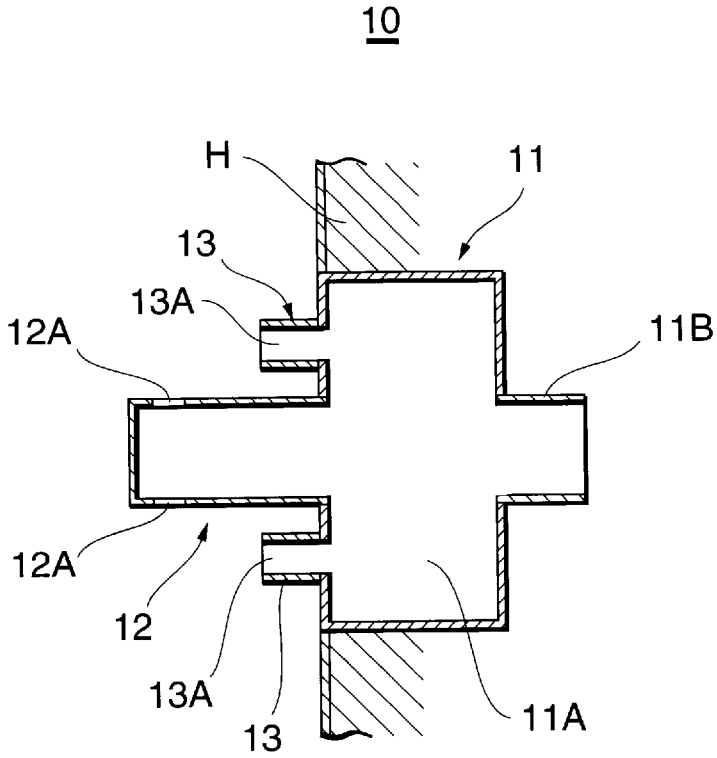
FIG. 1 is a sectional side view illustrating a first example of an embodiment according to the present invention.
Figure 2:
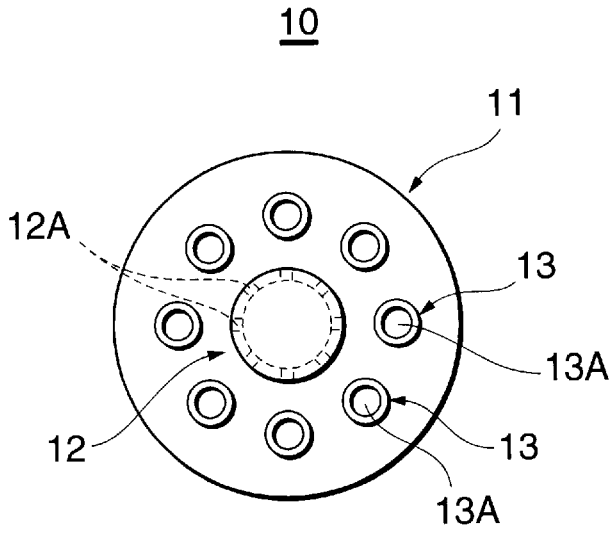
FIG. 2 is a front view of the example.

FIGS. 1 and 2 illustrate an example in an embodiment of a low-NOx burner according to the present invention.

FIG. 1 is a sectional side view of a low-NOx burner 10 of the example, and FIG. 2 is a front view.

In FIGS. 1 and 2, in a front central portion of a cylindrical-shaped body casing 11 installed in a furnace wall H, a hollow-shaped flame holding pipe 12 is integrally provided to protrude frontward from the front face of the body casing 11 and to be concentric with the body casing 11.

A premixture chamber 11A is formed inside the body casing 11, and communicates with a connecting port 11B formed in the rear portion of the body casing 11.

The flame holding pipe 12 has a closed leading end, and the interior thereof communicates with the interior of the premixture chamber 11A of the body casing 11.

On the outer circumferential face of the leading end of the flame holding pipe 12, a plurality of secondary flame-holding_nozzles 12A are formed at regular angular intervals to pass through a wall of the flame holding pipe 12 to extend their axes in a radial direction of the flame holding pipe 12.

In a circumferential edge portion of the front face of the body casing 11 surrounding the flame holding pipe 12, a plurality of main nozzles 13 are integrally mounted to the body casing 11 and extend in parallel with the axis direction of the body casing 11 at regular angular intervals.

In each main nozzle 13, a premixture injector orifice 13A is formed to extend in parallel with the axis direction of the body casing 11.

The main nozzle 13 is shorter in length than the flame holding pipe 12, and the premixture injector orifice 13A is located at a position closer to the body casing 11 than the position of the secondary flame-holding nozzle 12A of the flame holding pipe 12.

Figure 3:
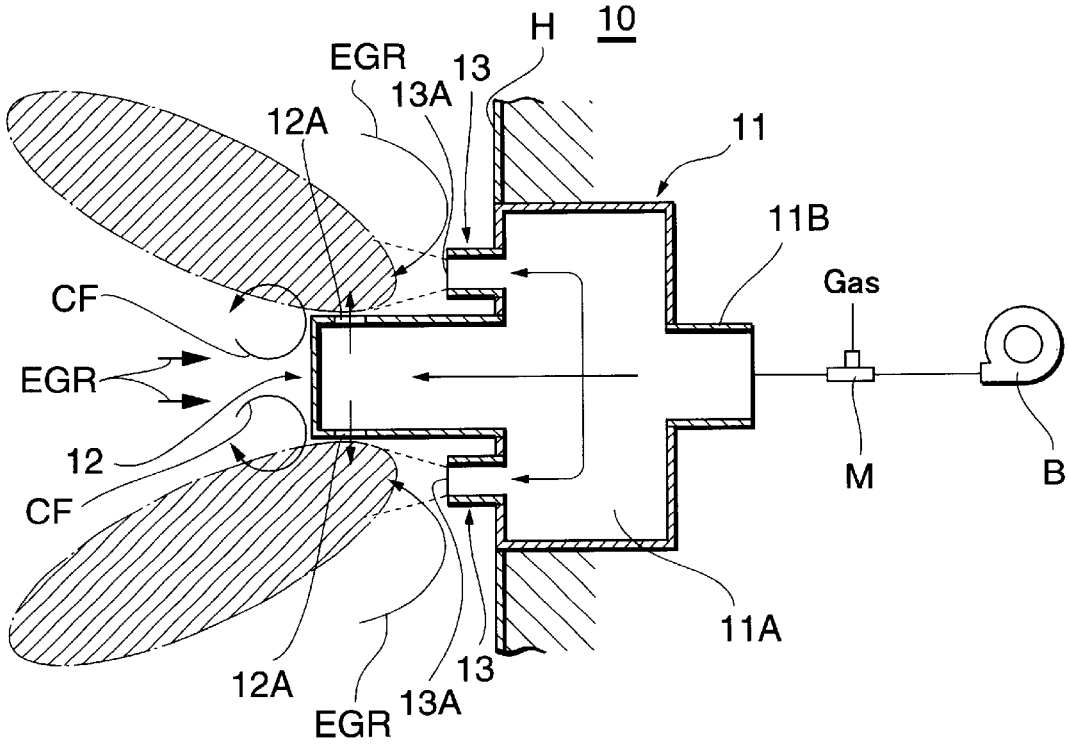
FIG. 3 is an explanatory view illustrating operation during a flame holding state in a low-NOx burner of the example.

As illustrated in FIG. 3, the low-NOx burner 10 is connected to an air blower B through a mixer M at the connecting port 11B of the body casing 11, in order to supply the premixture chamber 11A with a premixture formed by mixing fuel such as a gas and an oxidizer such as air in the mixer M.

The premixture of the fuel and the oxidizer supplied to the premixture chamber 11A is injected from each main nozzle 13 in parallel with the axis direction of the body casing 11 at high velocity, and reaches a position opposing to the secondary flame-holding nozzle 12A of the flame holding pipe 12 while_inducing and involving the exhaust gas EGR inside the furnace.

At this time, the premixture injected from the main nozzles 13 is not ignited yet because its injection velocity is high and it does not yet have a flame holding mechanism. The premixture in the premixture chamber 11A is injected from each secondary flame-holding nozzle 12A of the flame holding pipe 12 in the radial direction of the flame holding pipe 12, namely, in a direction perpendicular to the axis direction of each premixture injector orifice 13A of the main nozzle 13.

The premixture injected from the premixture injector orifice 13A reaches a position opposing to the secondary flame-holding nozzle 12A on its injection course while involving the exhaust gas EGR. Here the premixture from the injector orifice 13A is blown at an approximate right angle by the premixture injected from the secondary flame-holding nozzle 12A, to spread in a triangular shape. This produces a large circulation flow CF around the leading end of the flame holding pipe 12.

The circulation flow CF serves as an ignition source to hold the continuous combustion of the burner (the flame hold).

Thus, according to the above low-NOx burner 10, the circulation flow CF produced around the leading end of the flame holding pipe 12 applies ignition energy to the premixtures injected from the main nozzle 13 and secondary flame-holding nozzle 12A to execute the flame hold. This is a principle of the flame hold.

Moreover, an oxygen concentration in the premixture decreases because the premixture injected from the main nozzle 13 sufficiently involves the exhaust gas in the furnace before ignition, and a flame temperature decreases because the flame is moderately held, similar to the so-called lifted flame, at a distance from the furnace wall H. This is a principle of the low-NOx.

In this manner, the low-NOx burner 10 allows a NOx concentration in the exhaust gas discharged into air to significantly further reduce in comparison with that from conventional gas burners, particularly, the NOx concentration to be limited to 10 ppm (a converted value in $O_2$=0%) or less only by means of combustion by the burner.

Regarding the angle for making the premixture or oxidizer, injected from the secondary flame-holding nozzle 12A, impinge on the premixture injected from the main nozzle 13, any angle can be selected if the large circulation flow is formed at the meeting point of both premixtures. However, if such angle is set at an approximate right angle, the producing of circulation flow is accelerated. This allows the NOx concentration in the exhaust gas to further reduce.

Figure 4:
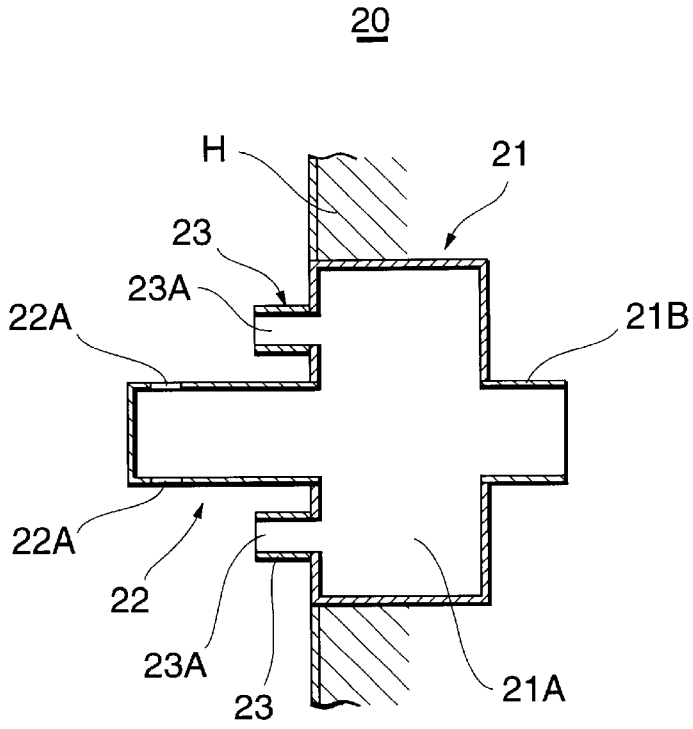
FIG. 4 is a sectional side view illustrating a second example of an embodiment according to the present invention.
Figure 5:
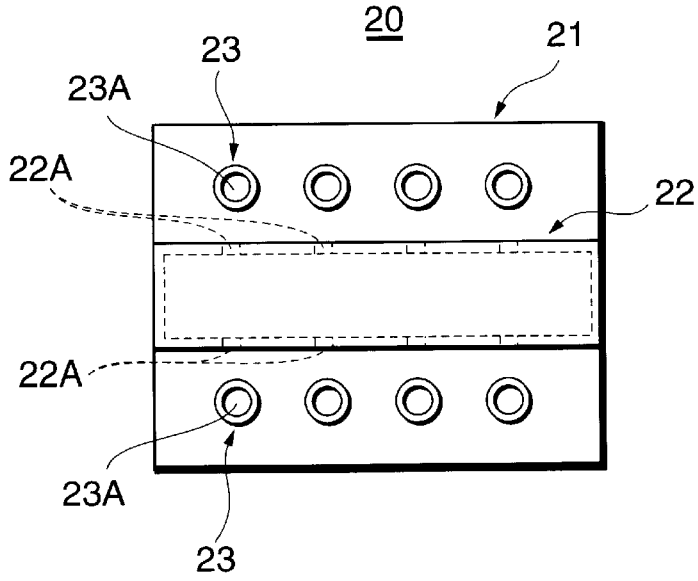
FIG. 5 is a front view of the second example.

FIGS. 4 and 5 illustrate a second example in the embodiment of the low-NOx burner according to the present invention.

FIG. 4 is a sectional side view of a low-NOx burner 20 in the example, and FIG. 5 is a front view.

In FIGS. 4 and 5, in a front central portion of a box-shaped body casing 21 installed in a furnace wall H, a hollow-box-shaped flame holding casing 22 is integrally provided to protrude from the front face of the body casing 21 in parallel with the axis direction of the body casing 21 and to extend its longitudinal direction along the width direction of the body casing 21.

A premixture chamber 21A is formed inside the body casing 21, and communicates with a connecting port 21B formed in the rear portion of the body casing 21.

The flame holding casing 22 has a closed leading end, and the interior thereof communicates with the interior of the premixture chamber 21A of the body casing 21.

On each of an upper surface and a lower surface of the leading end of the flame holding casing 22, a plurality of secondary flame-holding nozzles 22A are formed to be spaced from each other at regular intervals, and to pass through a wall of the flame holding casing 22 to extend its axis in a direction perpendicular to the external wall face of the flame holding casing 22.

In each of an upper edge portion and a lower edge portion of the front of the body casing 21 which hold the flame holding casing 22 in between, a plurality of main nozzles 23 are integrally mounted to the body casing 21 at respective positions corresponding to the secondary flame-holding nozzles 22A formed in the flame holding casing 22, and to extend in parallel with the axis direction of the body casing 21.

In each main nozzle 23, a premixture injector orifice 23A is formed to extend in parallel with the axis direction of the body casing 21.

The main nozzle 23 has a shorter length than a length of the flame holding casing 22 extending along the axis direction of the body casing 21, and the premixture injector orifice 23A is located at a position closer to the body casing 21 than a position of the secondary flame-holding nozzle 22A of the flame holding casing 22.

As in the case of the low-NOx burner 10 of the first example, the low-NOx burner 20 is also connected to an air blower through a mixer at the connecting port 21B of the body casing 21, to supply the premixture chamber 21A with a premixture formed by mixing gas and air. The premixture in the premixture chamber 21A is injected from each main nozzle 23 in parallel with the axis direction of the body casing 21 at high velocity, and then reaches a position opposing to the secondary flame-holding nozzle 22A of the flame holding casing 22 on its injection course while involving the exhaust gas in the furnace. Here, the premixture from the main nozzle 23 is blown by the premixture injected from the secondary flame-holding nozzle 22A at an approximate right angle.

This produces a circulation flow around the meeting position. The circulation flow serves as an ignition source to effect the flame hold, resulting in holding the continuously combustion of the burner.

Thus, as in the case of the low-NOx burner 10 of the first example, the low-NOx burner 20 also allows a NOx concentration in the exhaust gas discharged into air to significantly further reduce in comparison with that in conventional gas burners, particularly, the NOx concentration to be limited to 10 ppm (a converted value in $O_2$=0%) or less only by means of combustion by the burner.

Figure 6:
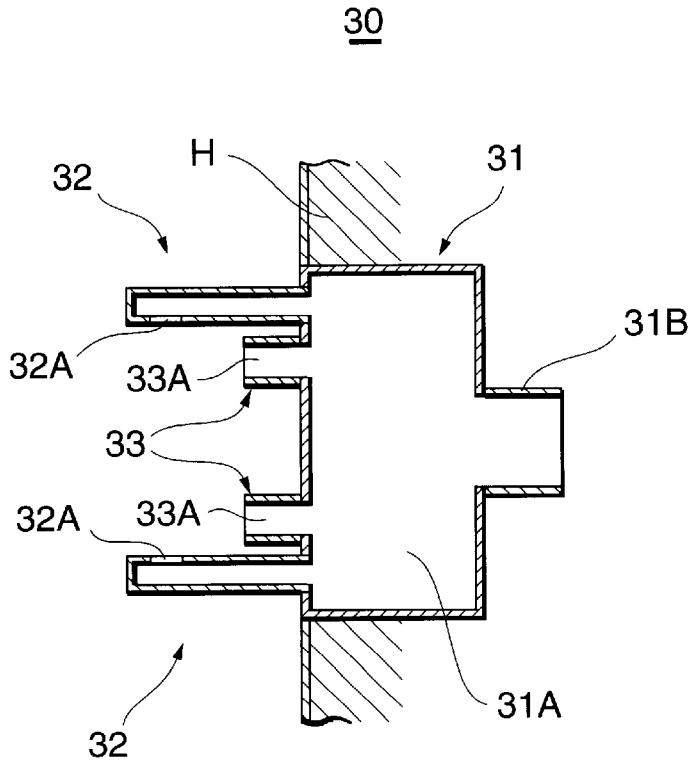
FIG. 6 is a sectional side view illustrating a third example of an embodiment according to the present invention.
Figure 7:
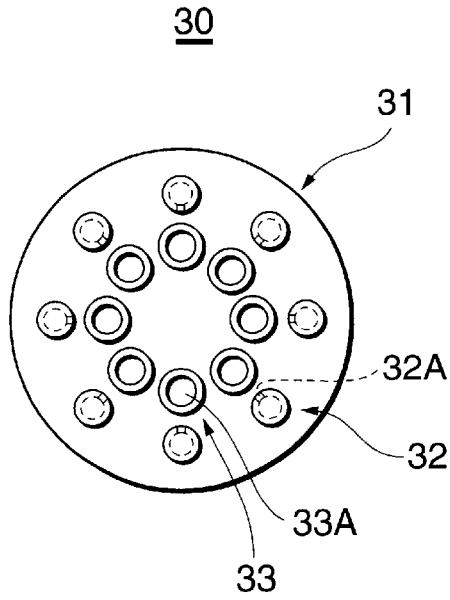
FIG. 7 is a front view of the third example.

FIGS. 6 and 7 illustrate a third example in the embodiment of the low-NOx burner according to the present invention.

FIG. 6 is a sectional side view of a low-NOx burner 30 in the example, and FIG. 7 is a front view.

In FIGS. 6 and 7, in a circumferential edge portion of the front of a cylindrical-shaped body casing 31 installed in a furnace wall H, a plurality of flame holding pipes 32 are integrally provided to protrude from the front face of the body casing 31 in parallel with the axis direction of the body casing 31 and at regular angular intervals.

A premixture chamber 31A is formed inside the body casing 31 to communicate with a connecting port 31B formed in the rear portion of the body casing 31.

The flame holding pipe 32 has a closed leading end, and the interior thereof communicates with the interior of the premixture chamber 31A of the body casing 31.

In the outer wall of the leading end of each flame holding pipe 32, a secondary flame-holding nozzle 32A is formed at a position facing inward and positioned parallel to the radial direction of the body casing 31. The secondary flame-holding nozzle 32A passes through a wall of the flame holding pipe 32 and its axis extends in a radial direction of the flame holding pipe 32.

Further on the front face of the body casing 31, main nozzles 33 are integrally provided, and the number of the main nozzle 33 is the same as that of the flame holding pipes 32. The main nozzles 33 are arranged concentrically around the center of the body casing 31 at positions corresponding to the respective flame holding pipes 32. Each main nozzle 33 protrudes from the front face of the body casing 31 in parallel with the axis direction of the body casing 31.

In each main nozzle 33, a premixture injector orifice 33A is formed to extend in parallel with the axis direction of the body casing 31.

Each main nozzle 33 is shorter in length than the flame holding pipe 32, and the premixture injector orifice 33A is located at a position closer to the body casing 31 than a position of the secondary flame-holding nozzle 32A of the flame holding pipe 32.

As in the case of the low-NOx burner 10 of the first example, the low-NOx burner 30 is also connected to an air blower through a mixer at the connecting port 31B of the body casing 31, to supply the premixture chamber 31A with a premixture formed by mixing gas and air. The premixture in the premixture chamber 31A is injected from each main nozzle 33 in parallel with the axis direction of the body casing 31 at high velocity, and then reaches a position opposing to the corresponding secondary flame-holding nozzle 32A of the flame holding pipe 32 on its injection course while_involving the exhaust gas in the furnace. Here, the premixture from the secondary flame-holding nozzle 32A is blown on the premixture injected from the main nozzle 33 at an approximate right angle.

This produces a circulation flow around the leading end of the flame holding pipe 32. The circulation flow serves as an ignition source to effect the flame hold, resulting in holding the continuous combustion of the burner.

Thus, as in the case of the low-NOx burner 10 of the first example, the low-NOx burner 30 also allows a NOx concentration in the exhaust gas discharged into air to significantly further reduce in comparison with that in conventional gas burners, particularly, the NOx concentration to be limited to 10 ppm (a converted value in $O_2$=0%) or less only by means of combustion by the burner.

Figure 8:
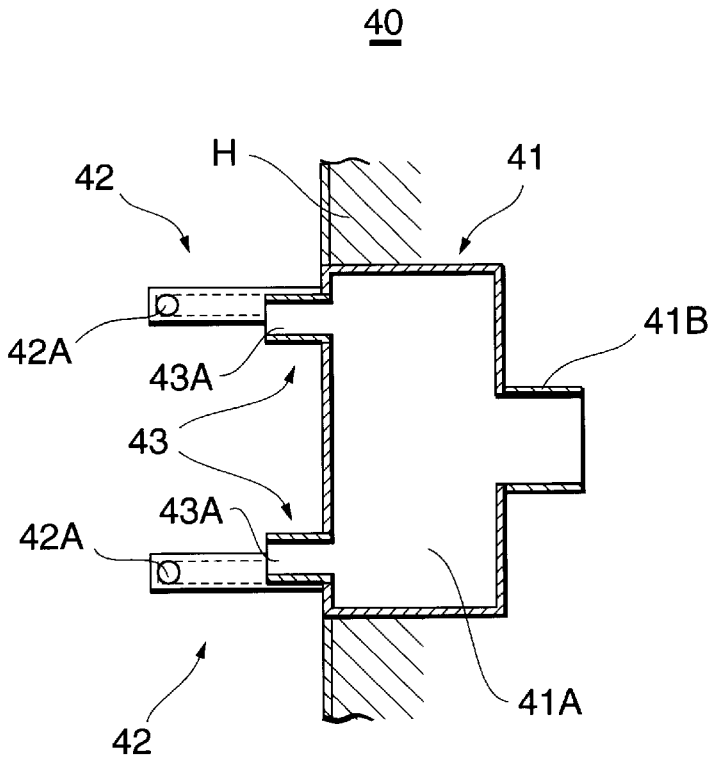
FIG. 8 is a sectional side view illustrating a fourth example of an embodiment according to the present invention.
Figure 9:
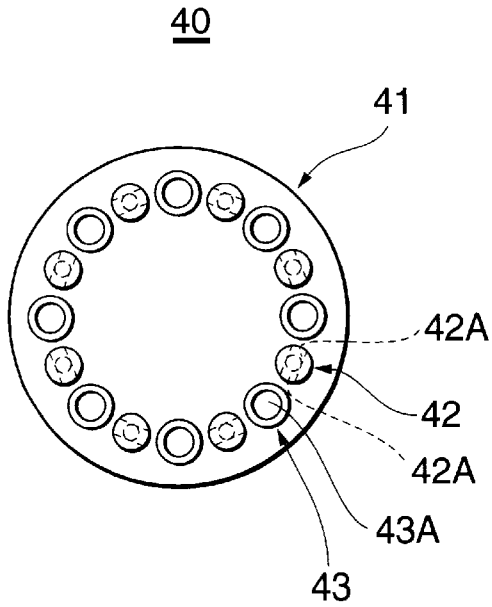
FIG. 9 is a front view of the fourth example.

FIGS. 8 and 9 illustrate a fourth example in the embodiment of the low-NOx burner according to the present invention.

FIG. 8 is a sectional side view of a low-NOx burner 40 in the example, and FIG. 9 is a front view.

In FIGS. 8 and 9, a plurality of flame holding pipes 42 and main nozzles 43 are provided integrally on a circumferential edge portion of the front face of a cylindrical-shaped body casing 41 installed in a furnace wall H. The flame holding pipes 42 and the main nozzles 43 are alternated at regular angular intervals on a circumference of a circle concentric with the body casing 41, and protrude from the front face of the body casing 41 in parallel with the axis direction of the body casing 41.

A premixture chamber 41A is formed inside the body casing 41 to communicate with a connecting port 41B formed in the rear of the body casing 41.

The flame holding pipe 42 has a closed leading end, and the interior thereof communicates with the interior of the premixture chamber 41A of the body casing 41.

In the outer wall of the leading end of each flame holding pipe 42, secondary flame-holding nozzles 42A are formed respectively on both sides facing toward the circumferential direction of the body casing 41. The secondary flame-holding nozzle 42A passes through a wall of the flame holding pipe 42 and its axis extends in the circumferential direction of the circle concentric with the body casing 41.

In each main nozzle 43, a premixture injector orifice 43A is formed to extend in parallel with the axis direction of the body casing 41.

The main nozzle 43 is shorter in length than the flame holding pipe 42, and the premixture injector orifice 43A is located at a position closer to the body casing 41 than a position of the secondary flame-holding nozzle 42A of the flame holding pipe 42.

As in the case of the low-NOx burner 10 of the first example, the low-NOx burner 40 is also connected to an air blower through a mixer at the connecting port 41B of the body casing 41, to supply the premixture chamber 41A with a premixture formed by mixing gas and air. The premixture in the premixture chamber 41A is injected from each main nozzle 43 in parallel with the axis direction of the body casing 41 at high velocity, and then reaches a position opposing to the secondary flame-holding nozzle 42A of the flame holding pipe 42 on its injection course while involving the exhaust gas in the furnace. Here, the premixture from the secondary flame-holding nozzle 42A is blown on the premixture injected from the main nozzle 43 at an approximate right angle.

This produces a circulation flow around the leading end of each flame holding pipe 42. The circulation flow serves as an ignition source to effect the flame hold, resulting in holding the continuous combustion of the burner.

Thus, as in the case of the low-NOx burner 10 of the first example, the low-NOx burner 40 also allows a NOx concentration in the exhaust gas discharged into air to significantly further reduce in comparison with that in conventional gas burners, particularly, the NOx concentration to be limited to 10 ppm (a converted value in $O_2$=0%) or less only by means of combustion by the burner.

Figure 10:
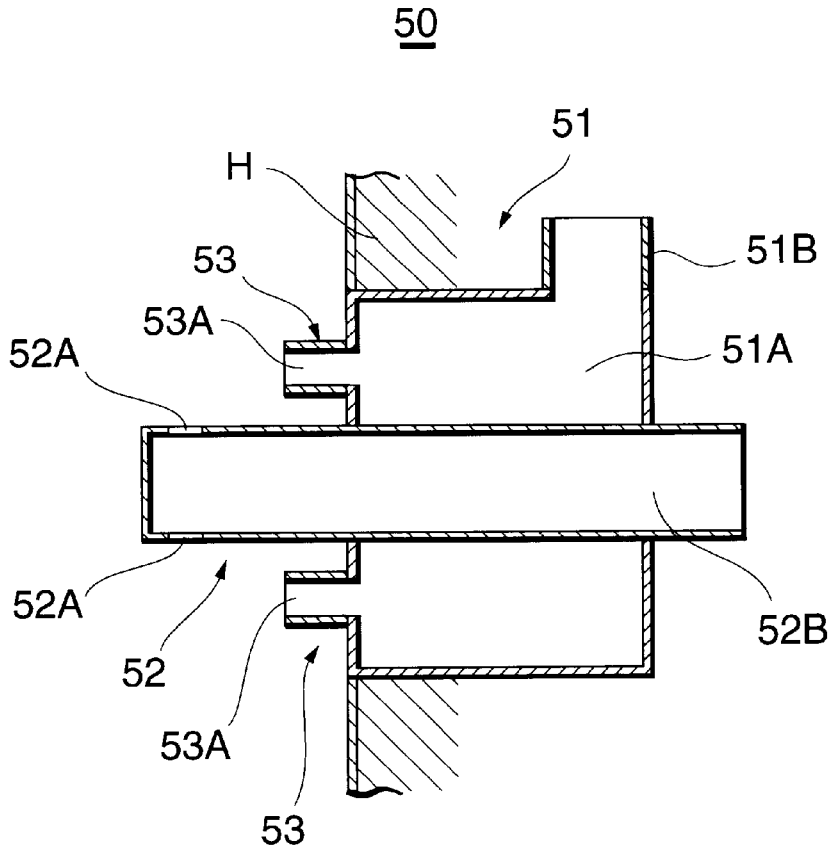
FIG. 10 is a sectional side view illustrating a fifth example of an embodiment according to the present invention.

FIG. 10 illustrates a fifth example in the embodiment of the low-NOx burner according to the present invention.

In each low-NOx burner of the aforementioned first to fourth examples, a ratio of air to fuel for the premixture injected from the secondary flame-holding nozzle is the same as that for the premixture from the main nozzle. In the fifth example, however, a low-NOx burner 50 is designed such that a percentage of an oxidizer making up a premixture can be changed between a flame-holding premixture injected from a secondary flame-holding nozzle 52A and a main premixture injected from a main nozzle 53.

Specifically, although the configuration of the flame holding pipe 52 and the main nozzle 53 on the front of a body casing 51 of the low-NOx burner 50 is the same as that of the low-NOx burner 10 in the first example, a flame-holding premixture chamber 52B is formed in the rear portion of the flame holding pipe 52. The flame-holding premixture chamber 52B is isolated from a main premixture chamber 51A formed in the body casing 51.

In the low-NOx burner 50, the main premixture chamber 51A and the flame-holding premixture chamber 52B are respectively connected to separate mixers in order to be fed with the respective premixtures which are different in oxidizer percentage between the main premixture chamber 51A and the flame-holding premixture chamber 52B. The premixtures independently fed are injected from the secondary flame-holding nozzle 52A and the main nozzle 53, respectively.

The low-NOx burner 50 enables to independently control the flow velocities of the flame-holding premixture injected from the secondary flame-holding nozzle 52A and the main premixture injected from the main nozzle 53.

It should be mentioned that although the above explanation has been made for the example in which the premixture is injected from the secondary flame-holding nozzle 52A and blown on the premixture injected from the main nozzle 53, in the above example, the secondary flame-holding nozzle 52A may inject the oxidizer such as air.

The terms and description used herein are set forth by way of illustration only and are not meant as limitations. Those skilled in the art will recognize that numerous variations are possible within the spirit and scope of the invention as defined in the following claims.

What is claimed is:

1. A low-$NO_x$ burner, comprising:

a plurality of nozzle members for injecting a premixture formed by mixing fuel and an oxidizer; and a flame holding member for injecting the premixture toward the premixture injected from each nozzle member in a direction to intersect a direction of premixture injection from said each nozzle member, wherein said flame holding member includes injector orifices positioned downstream from a position of said each nozzle member in an injection direction, and wherein the premixture injected from said flame holding member and said each nozzle member is mixed by a mixer that mixes the fuel and oxidizer.

2. The low-$NO_x$ burner according to claim 1, wherein the injection direction of the premixture injected from said each nozzle member and the injection direction of the premixture injected from said flame holding member intersect each other at approximately right angles.

3. The low-NOx burner according to claim 1, wherein a the plurality of nozzle members are circularly arranged on a front face of a body casing of the burner, and wherein said flame holding member is situated at the center of said plurality of nozzle members circularly arranged on the front face of said body casing, each injector orifice having an axis extending in a direction substantially perpendicular to the injection direction of said each nozzle member.

4. A combustion method for a low-$NO_x$ burner, comprising the steps of:

injecting a premixture formed by mixing fuel and an oxidizer from a plurality of nozzle members; and making the premixture injected from each nozzle member impinge the premixture injected from injector orifices of a flame holding member positioned in a center position of flow formed by the premixture injected from said plurality of nozzle members in a an injection direction to intersect a direction of premixture injection from said each nozzle member for combustion, wherein said injector orifices of said flame holding member are positioned downstream from a position of said each nozzle member in the injection direction, and wherein the premixture injected from said flame holding member and said each nozzle member is mixed by a mixer that mixes the fuel and oxidizer.

5. The combustion method for a low-$NO_x$ burner according to claim 4, wherein the premixture injected from said each nozzle member is blown on the premixture injected from said flame holding member at an approximate right angle.

* * * * *